US005613340A

United States Patent [19]

Bollaert et al.

[11] Patent Number: 5,613,340

[45] Date of Patent: Mar. 25, 1997

[54] REINFORCEMENT MEMBER FOR THE REINFORCEMENT OF CONCRETE STRUCTURES

[75] Inventors: Geoffroy Bollaert, Paris, France; Vincent Gillet, Washington, D.C.; Georges J. M. Guerin, la Celle St Cloud; Alain de Bon, Saint Germain en Laye, both of France

[73] Assignee: Sollac, Puteaux, France

[21] Appl. No.: 229,679

[22] Filed: Apr. 19, 1994

[30] Foreign Application Priority Data

Apr. 20, 1993 [FR] France ..... 93 04647

[51] Int. Cl.[6] ..... E04C 3/30

[52] U.S. Cl. ..... 52/740.4; 52/740.1

[58] Field of Search ..... 52/737, 738, 739, 52/602, 730.2, 630, 674, 675, 740.1, 180, 177, 740.2, 740.3, 740.4, 309.7, 309.16; 72/420; 404/45, 70, 100; 403/375

[56] References Cited

U.S. PATENT DOCUMENTS

| | | | |
|---|---|---|---|
| 1,029,864 | 6/1912 | Goldsmith | 52/674 |
| 1,052,683 | 2/1913 | McDonald | 52/740.2 |
| 1,169,811 | 2/1916 | Havemeyer | 52/740.2 |
| 1,821,696 | 9/1931 | Edge . | |
| 2,246,578 | 6/1941 | De Salardi | 52/737 X |
| 3,214,877 | 11/1965 | Akin . | |
| 3,839,837 | 10/1974 | Jaconeli | 52/674 |
| 4,198,795 | 4/1980 | Barnidge | 52/180 |
| 5,154,534 | 10/1992 | Guerin et al. | 404/70 |

FOREIGN PATENT DOCUMENTS

| | | |
|---|---|---|
| 379741 | 11/1907 | France . |
| 2325778 | 9/1975 | France . |
| 2579651 | 3/1985 | France . |
| 248749 | 1/1911 | Germany . |
| 803675 | 7/1949 | Germany . |

*Primary Examiner*—Kien T. Nguyen

*Attorney, Agent, or Firm*—Oblon, Spivak, McClelland, Maier & Neustadt, P.C.

[57] ABSTRACT

A reinforcement member including a reelable steel tape intended to be incorporated into concrete. The faces of the steel tape each include substantially rectilinear ribs arranged in at least one longitudinal row, these being substantially parallel to each other and inclined in relation to the longitudinal direction of the tape. The ribs of one of the faces of the tape are symmetrical with the ribs of the other of the faces of the tape in relation to the mid-plane of the tape, parallel to the faces of this tape.

15 Claims, 9 Drawing Sheets

REINFORCEMENT MEMBER FOR THE REINFORCEMENT OF CONCRETE STRUCTURES

BACKGROUND OF THE INVENTION

1. Field of the Invention

The present invention relates to a reinforcement member for the reinforcement of concrete structures and to a method and a device for manufacturing this reinforcement member.

It applies in particular to the manufacture of reinforced-concrete slabs or panels intended for the construction of road pavements or runways, especially for motorways.

2. Discussion of the Background

A reinforcement member for reinforced-concrete slabs intended for the manufacture of road pavements, comprising a relatively narrow steel tape of small thickness, the faces of which are goffered or corrugated, is already known in the state of the art, especially from FR-A-2,579,651.

The goffering includes reliefs constituted, alternately, by projections delimiting bumps and by hollows delimiting cavities.

This type of goffering makes it possible to obtain good anchoring of the steel tape in the concrete, the effect of which is an almost complete mobilization of the strength of the reinforcement member, this being so if the concrete used has a very high strength and that the relative movements between the steel and the concrete, when a tensile force is being exerted on this tape, are greater than one millimeter.

On the other hand, when a steel tape possessing the aforementioned type of goffering is embedded in plain or lean concrete, it is found that, under the effect of a tensile force exerted on this tape, complete mobilization of the strength of the reinforcement member due to its anchoring in the concrete occurs only progressively and remains incomplete for relative movements between the steel and the concrete or the order of one quarter of a millimeter.

Now, in the case of structures such as reinforced-concrete road pavements, significant mobilization of the strength of the steel tapes is generally required for relative movements between the steel and the concrete which remain less than one quarter of a millimeter.

Moreover, the reinforcement tapes are generally packaged as reels so that, at the time they are used, the unreeled tapes exhibit a remanent or residual curvature which is very irksome when laying these tapes for the manufacture of reinforced-concrete structures.

SUMMARY OF THE INVENTION

The object of the invention is especially to optimize the mobilization of the strength of the steel tapes intended to reinforce plain or lean concrete structures, when the relative movements between the steel and the concrete are very small, and this is so by supplying reinforcement tapes which can be packaged as reels and which do not exhibit curvature after having been unreeled.

For this purpose, the subject of the invention is a reinforcement member for the reinforcement of concrete structures, especially concrete slabs or panels, comprising a reelable steel tape intended to be incorporated into the concrete, characterized in that the faces of the steel tape each comprise ribs arranged in at least one longitudinal row, these being substantially parallel to each other and inclined at an angle $\alpha$ in relation to the longitudinal direction of the tape.

According to characteristics of various embodiments of this reinforcement member:

- the ribs of one of the faces of the tape are symmetrical with the ribs of the other of the faces of the tape in relation to the mid-plane of the tape, parallel to the faces of this tape;
- the steel tape has a high elastic limit, greater than 650 MPa;
- the ribs are substantially rectilinear;
- the angle of inclination $\alpha$ has an absolute value lying between 45° and 90°;
- each face of the steel tape comprises at least two rows of ribs arranged side by side along the width of the tape, the ribs of these two rows having opposite angles of inclination $\alpha$;
- each face of the steel tape comprises at least two rows of ribs arranged side by side along the width of the tape, the ribs of these two rows having identical angles of inclination $\alpha$;
- each face of the steel tape comprises an even number of rows of ribs, these rows being distributed symmetrically in relation to the central longitudinal axis of the tape;
- each face of the steel tape comprises at least two rows of ribs arranged side by side along the width of the tape, the close-together ends of the ribs of these two rows being mutually offset longitudinally;
- each row of ribs is bordered laterally by smooth longitudinal areas;
- the ribs of the same row are spaced apart longitudinally with a constant pitch lying between 3 and 20 mm, preferably between 5 and 10 mm;
- the width of the base of each rib lies between 1 and 4 mm, preferably equal to approximately 2.5 mm;
- the height of each rib lies between 0.1 and 0.5 mm;
- the cross-section of each rib is substantially delimited by an isosceles trapezium, the non-parallel sides of which make an angle $\beta$ of approximately 45° in relation to the base of this trapezium;
- the steel tape comprises an oblong hole and a hook which are both arranged at opposite ends of the tape, forming means for catching this tape, especially with another identical tape or with a reel for reeling up the tape, possessing complementary catching means;
- the oblong hole has a rectangular general shape and the hook is formed by a lanced element of rectangular general shape made in the tape.

The subject of the invention is also a method of manufacturing a steel tape of a reinforcement member for concrete structures, especially concrete slabs or panels, the reinforcement member comprising a steel tape intended to be incorporated in the concrete, characterized in that:

- longitudinal rows of ribs are formed on the faces of a steel sheet or strip, these being substantially rectilinear and inclined in relation to a longitudinal axis of the strip, the rows being spaced apart along the width of the strip by smooth longitudinal areas; and
- the strip is slit along chosen smooth longitudinal areas so as to form tapes of desired width comprising at least one row of ribs on each of its faces.

According to the characteristics of the various embodiments of this method:

- the ribs are formed by continuously passing the steel strip between two corrugating rolls, each of these rolls being intended to form ribs on a corresponding face of the strip so that the ribs of one face are symmetrical with the ribs of the other face in relation to the mid-plane of the strip, parallel to the faces of this strip;

the ribs are formed by the cold-working of a steel strip obtained by cold- or hot-rolling, in such a way that, after the final cold-working pass, the elastic limit of the strip is high, preferably greater than 650 MPa;

the ribs are hot-formed on a steel strip of high elastic limit, preferably greater than 650 MPa.

The subject of the invention is also a device for manufacturing a steel tape of a reinforcement member for concrete structures or, especially, concrete slabs or panels, the reinforcement member comprising a steel tape intended to be incorporated in the concrete, the device being of the type possessing a stand, two parallel corrugating rolls, each mounted on a drive shaft carried by bearings, means for adjusting the gap between the corrugating rolls and means for the synchronized rotational driving of said corrugating rolls, characterized in that each corrugating roll possesses, on the one hand, a set of independent and juxtaposed discs mounted on the corresponding drive shaft and the working faces of which are provided with projecting parts of conjugate shape in order to produce the said ribs on the faces of the strip and, on the other hand, means for the relative positioning of the projecting parts of each disc in relation to the adjacent discs depending on the distribution of the ribs on the faces of the strip, the discs of each set being connected together and to the corresponding drive shaft by linkage means.

According to the characteristics of the various embodiments of this device:

the projecting parts of each disc are inclined at an angle $\alpha'$ in relation to the axis of the disc;

the means for the relative positioning of the projecting parts of each disc in relation to the adjacent discs are formed by transverse holes, angularly and radially distributed over the lateral faces of each of the said discs, the axes of the holes being parallel to the drive shaft and the holes being intended to interact with the means for linking the discs with the said drive shaft;

the means for linking the discs of each corrugating roll with the corresponding drive shaft are formed, on the one hand, by two parallel plates gripping the said discs and, on the other hand, by ties connecting the two plates and passing through the discs via the said holes, one of the plates carrying the corresponding drive shaft and the said drive shaft passing through the other of the said plates;

the means for linking the discs of each corrugating roll with the corresponding drive shaft are formed, on the one hand, by two parallel side-plates gripping the said discs and being rotationally integral with the said drive shaft and, on the other hand, by ties connecting the two side-plates and passing through the discs via the said holes;

the device possesses means for guiding the strip upstream and downstream of the corrugating rolls in relation to the running direction of the strip in order to limit the lifting and skiing effects of said strip;

the device possesses means for slitting the strip so as to form tapes of a desired width and means for grinding the longitudinal edges of the tapes.

BRIEF DESCRIPTION OF THE DRAWINGS

Exemplary embodiments of the invention will be described hereinbelow, with reference to the appended drawings in which.

DESCRIPTION OF THE PREFERRED EMBODIMENTS

FIGS. 1 to 4 show a reinforcement member according to a first embodiment of the invention, comprising a steel tape 10 intended to reinforce a concrete structure, for example a continuously manufactured reinforced-concrete road-pavement slab.

The tape 10 may be made of galvanized steel.

Figure 1:
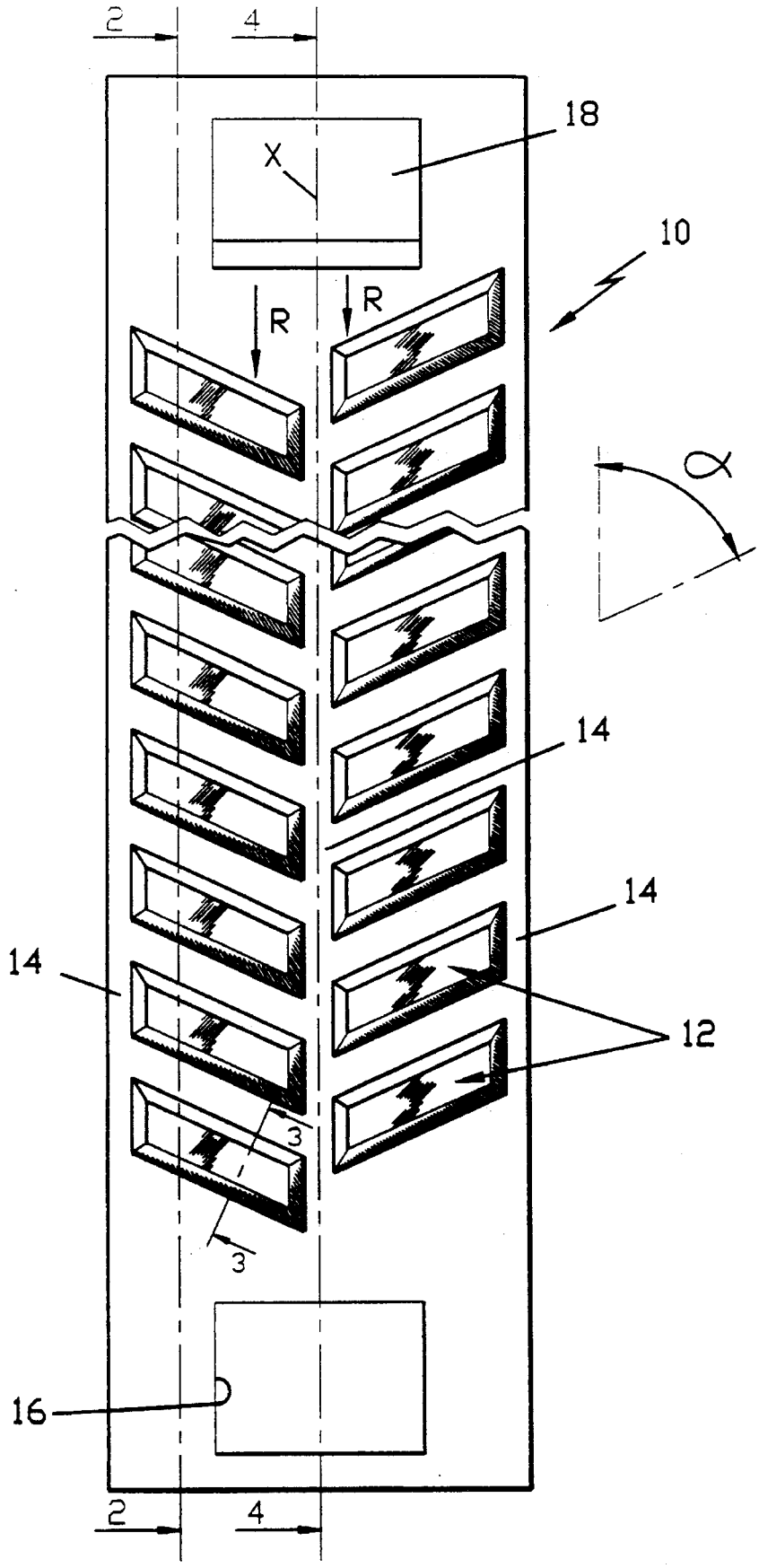
FIG. 1 is a front view of a reinforcement member according to a first embodiment of the invention.
Figure 2:
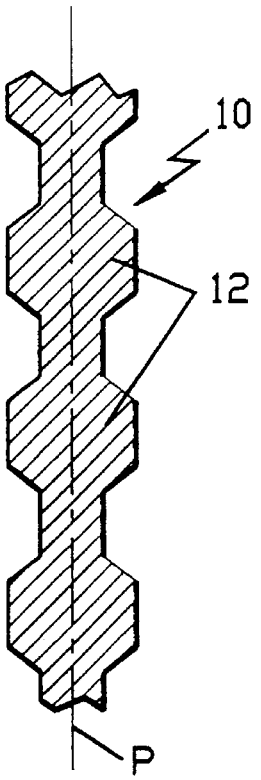
FIG. 2 is a sectional view along the line 2—2 of FIG. 1.

Referring to FIGS. 1 and 2, it may be seen that each of the faces of the tape 10 possesses rectilinear ribs 12 arranged in two longitudinal rows R. Each row R is arranged in one of the two halves of the tape 10 which are symmetrical in relation to the central longitudinal axis X of the tape 10.

The ribs 12 of each row R are substantially parallel to each other and inclined in relation to the longitudinal direction of the tape 10 at an angle $\alpha$ having an absolute value preferably lying between 45° and 90°.

In the example described, the ribs 12 have an angle of inclination $\alpha$ of approximately 60° in absolute value.

Referring in particular to FIG. 2, it may be seen that the ribs 12 of one of the faces of the tape are symmetrical with the ribs of the other of the faces of the tape in relation to the mid-plane P of the tape, parallel to the faces of this tape.

Referring once again to FIG. 1, it may be seen that the ribs 12 of the same row R are spaced apart longitudinally with a constant pitch lying between 3 and 20 mm, preferably between 5 and 10 mm.

The close-together ends of the ribs 12 of the two rows R are mutually offset longitudinally and the ribs 12 of one of the rows R form angle of inclination opposite that of the ribs 12 of the other row R so as to form a herring-bone pattern.

It may also be seen in FIG. 1 that each row of ribs is bordered laterally by smooth longitudinal areas 14, the smooth area 14 arranged between the two rows R being aligned with the central longitudinal axis X of the tape 10.

Figure 3:
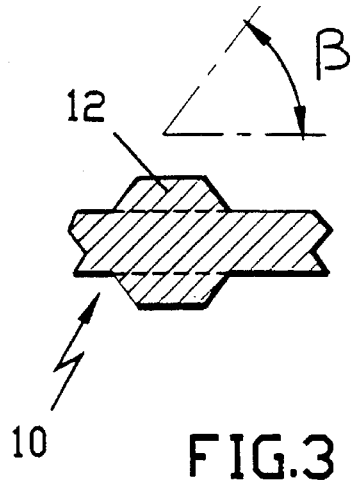
FIG. 3 is a sectional view along the line 3—3 of FIG. 1.

Referring to FIGS. 1 to 3, it may be seen that each rib 12 has an elongate shape and possesses a cross-section delimited by an isosceles trapezium.

Referring in particular to FIG. 3, it may be seen that the non-parallel sides of the isosceles trapezium make an angle $\beta$ of approximately 45° with the base of this trapezium.

As a variant, the upper faces of the ribs may be located in the plane of the tape.

The ribs may have other possible substantially rectilinear shapes, in particular shapes in the form of an elongate S comprising a rectilinear central part and slightly curved ends.

Preferably, the height of each rib 12 lies between 0.1 and 0.5 mm and the width of the base of each rib 12 lies between 1 and 4 mm.

In the example described, the width of the base of each rib 12 is equal to approximately 2.5 mm.

Figure 4:
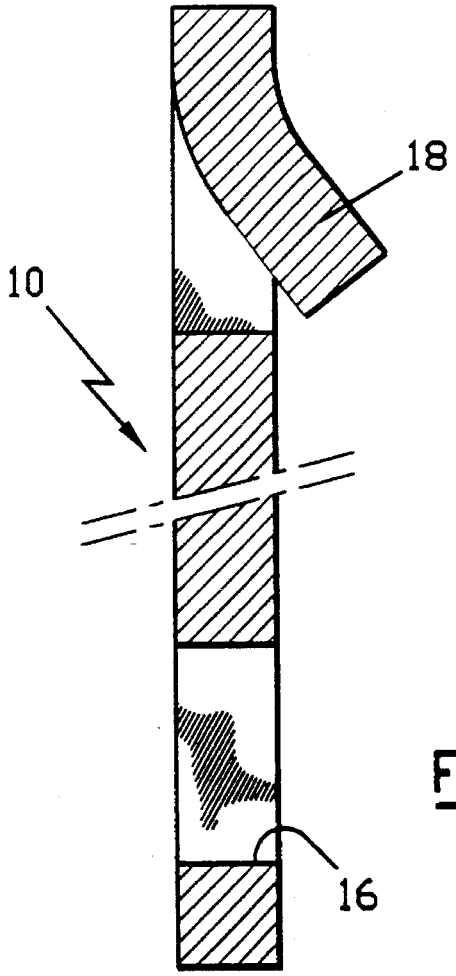
FIG. 4 is a sectional view along the line 4—4 of FIG. 1.

Referring to FIGS. 1 and 4, it may be seen that the tape 10 possesses in addition an oblong hole 16 and a hook 18 both arranged at opposite ends of the tape.

Preferably, the oblong hole 16 has a rectangular general shape and the hook 18 is formed by a lanced element of a rectangular general shape made in the tape.

The corners of the oblong hole may be rounded.

The oblong hole 16 and the hook 18 form means for receiving the tape 10, especially either with another identical tape aligned with it during the manufacture of a reinforced-concrete structure or with a reel for reeling up the tape 10, possessing catching means complementary to the hook or to the oblong hole.

Preferably, the oblong hole 16 and the hook 18 are aligned along the central longitudinal axis X of the tape 10.

A method for manufacturing a reinforcement tape according to the invention will now be described.

Firstly, longitudinal rows of substantially rectilinear ribs are formed on the faces of a steel sheet or strip having a high elastic limit, preferably greater than 650 MPa.

Such a steel strip is obtained, for example, by the hot-rolling of a steel strip of thickness lying between 1.5 and 6 mm, possessing a carbon content of less than 0.9% by weight and an elastic limit equal to approximately 500 MPa, and then, while cold-rolling this steel strip, by cold-working, imposing a cold-working ratio of greater than 40%. A steel strip is then obtained having a thickness lying between 0.8 and 2.5 mm and an elastic limit greater than 650 MPa.

The ribs are preferably formed by continuously passing the steel strip between two corrugating rolls, each roll comprising juxtaposed discs possessing, over their contour in contact with the corresponding face of the strip, projecting parts which are the inverse of those which it is wished to form on this strip, so that the ribs of one of the faces of the strip are symmetrical with the ribs of the other of the faces in relation to the mid-plane of the strip, parallel to the faces of this strip.

The rows of ribs are formed side by side along the width of the strip, these being spaced apart by smooth longitudinal areas, for example so as to reproduce, over the width of the sheet, a series of herringbone patterns such as the one shown in FIG. 1.

The steel strip undergoes cold-working, the degree of which depends on the height of the ribs formed on the faces of the strip.

After forming the ribs, the steel strip is slit along chosen smooth longitudinal areas so as to form tapes of desired width comprising at least one row of ribs on each of their faces.

As a variant, the operation of forming the ribs or the slitting operation may be preceded by a continuous galvanizing operation by immersion-coating the strip.

Preferably, the strip is slit so as to form tapes of a width lying between 30 and 40 mm, possessing two rows of ribs on each of their faces so as to form a herring-bone pattern, such as the one shown in FIG. 1. This tape may also be slit into two along the central smooth area.

Figure 5:
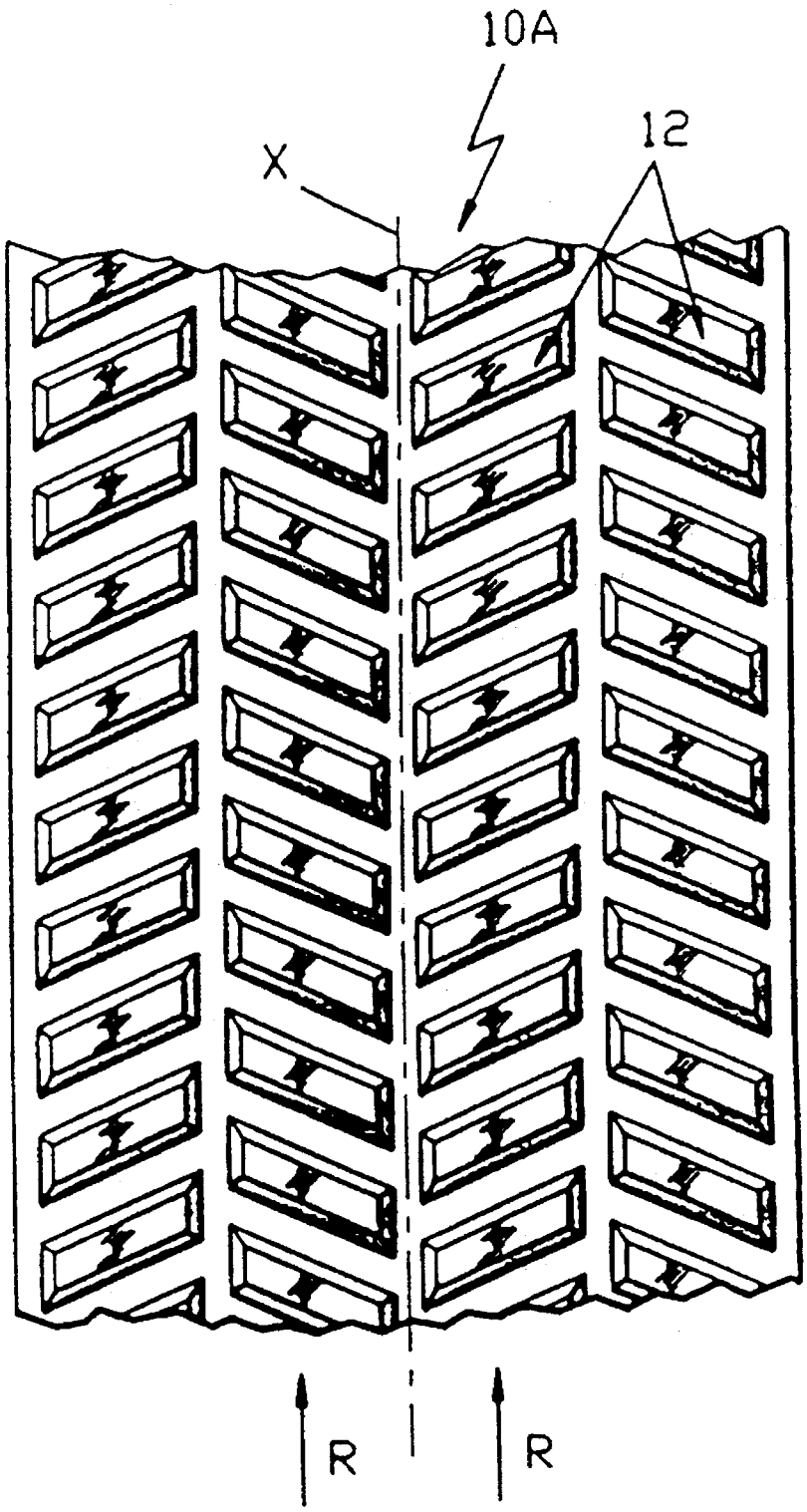
FIGS. 5 to 7 are partial front views of a reinforcement member, respectively according to a second, a third and a fourth embodiment of the invention.

According to yet another possibility, it is possible to form, as is shown in FIG. 5, a tape 10A of width substantially identical to that of the tape 10 shown in FIG. 1, possessing herring-bone patterns, similar to the one of the tape 10, formed by four rows R of ribs which are narrower than the rows of ribs of the tape 10.

As a variant, the ribs may be formed by any means for the cold-working of a steel strip obtained by cold-or hot-rolling, in such a way that, after the final cold-working pass, the elastic limit of the strip is high, preferably greater than 650 MPa.

According to another variant, the ribs may be hot-formed on a steel strip of high elastic limit, preferably greater than 650 MPa.

Figure 6:
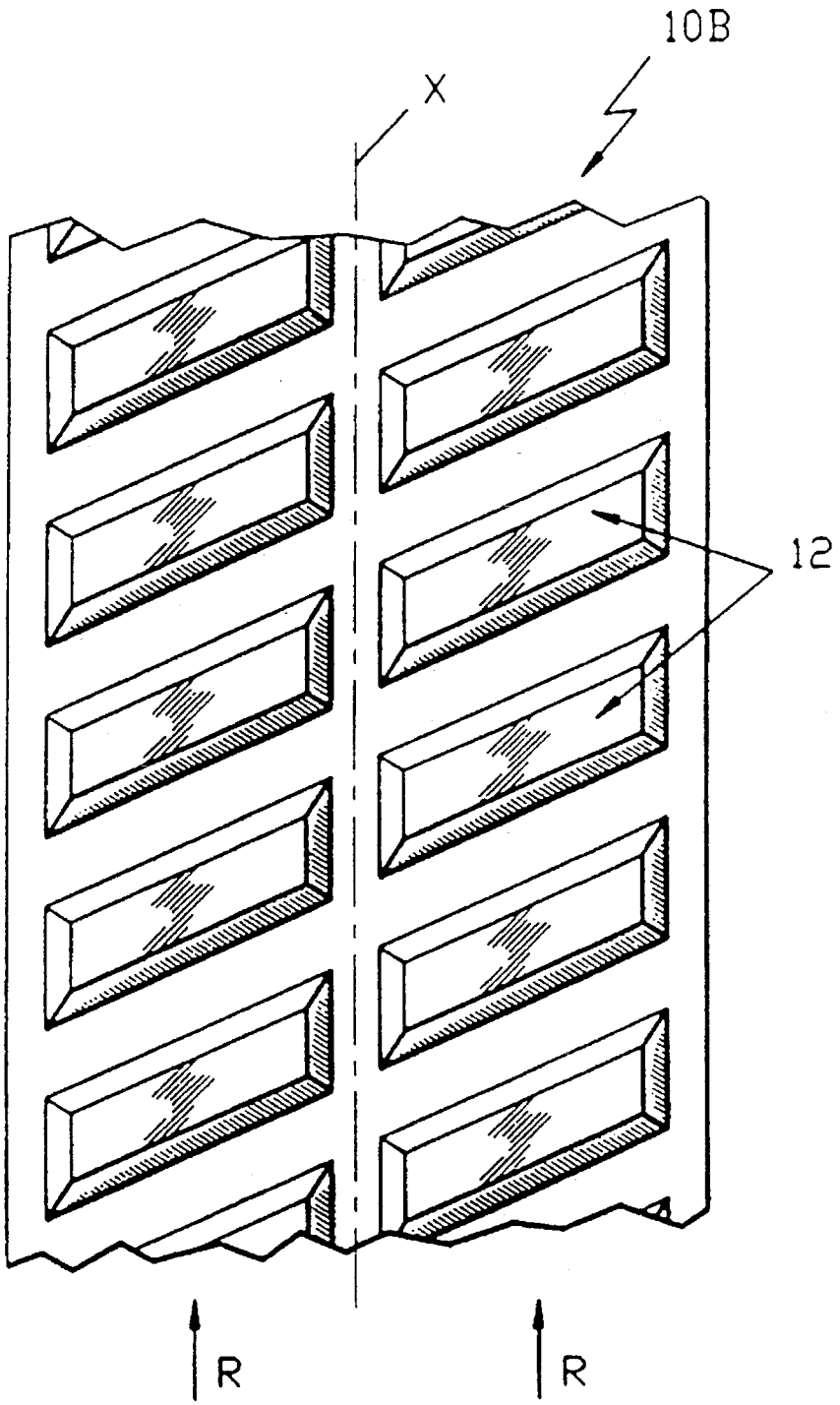

FIG. 6 shows a reinforcement tape 10B according to another embodiment of the invention.

This tape 10B differs from the tape 10A of FIG. 1 by the fact that the ribs 12 of each row R have an identical inclination in relation to the central longitudinal axis X of the tape.

Figure 7:
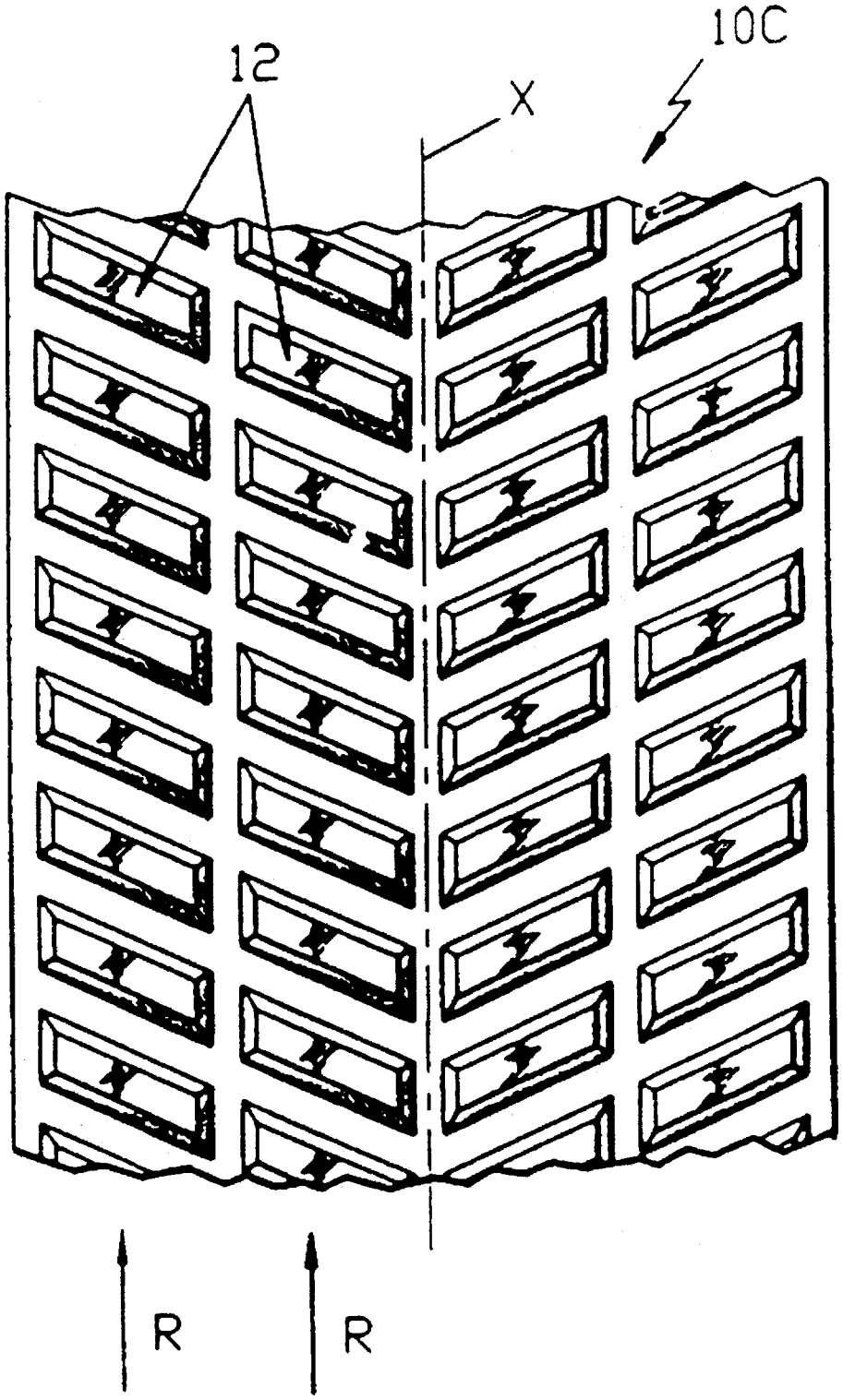

FIG. 7 shows a tape 10C according to yet another embodiment of the invention.

This tape 10C has a width substantially identical to that of the tape 10B shown in FIG. 6, but possesses four rows R of ribs which are narrower than the rows of ribs of the tape 10B.

The tape 10C possesses, on each side of the central longitudinal axis X, two rows R of ribs 12, the ribs arranged on one side of the axis X having identical inclinations in relation to this axis, and the ribs belonging to two rows arranged on either side of the axis X having opposite inclinations.

In this case, the close-together ends of two ribs of rows R side by side are facing each other.

According to other embodiments, the tape may possess any number of rows of ribs, that is to say an even number or an odd number. Preferably, each face of the steel tape comprises an even number of rows of ribs, these rows being distributed symmetrically in relation to the central longitudinal axis of the tape.

Figure 8:
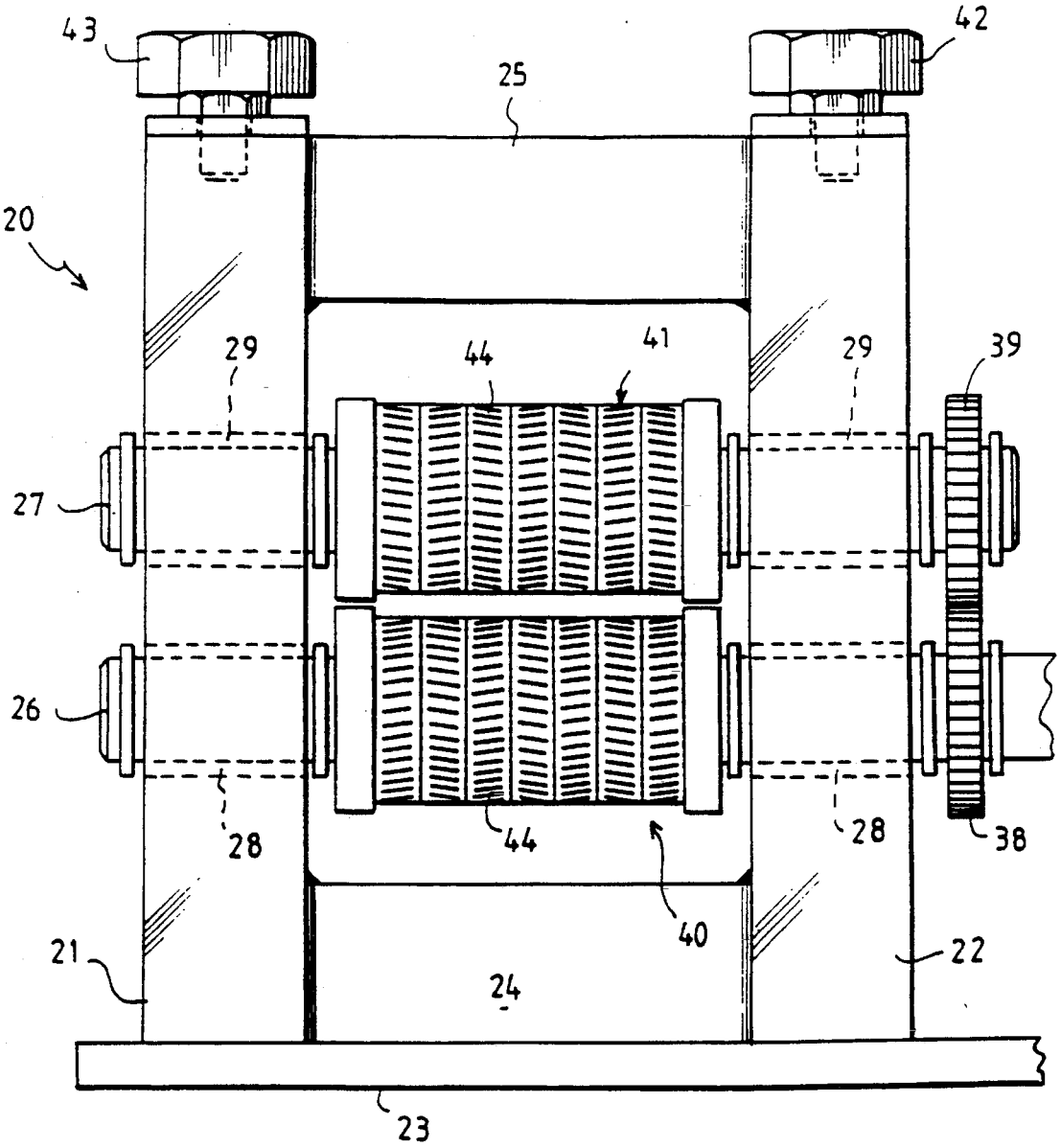
FIG. 8 is a front view of the device for manufacturing a reinforcement member according to the invention.

The manufacturing device shown in FIGS. 8 and possesses a stand 20 comprising two pairs of columns 21 and 22 supported by a baseplate 23 and connected together by cross-members 24 and 25.

The columns 21 and 22 support the ends of two parallel drive shafts 26 and 27, via, respectively, bearings 28 and 29.

Figure 9:
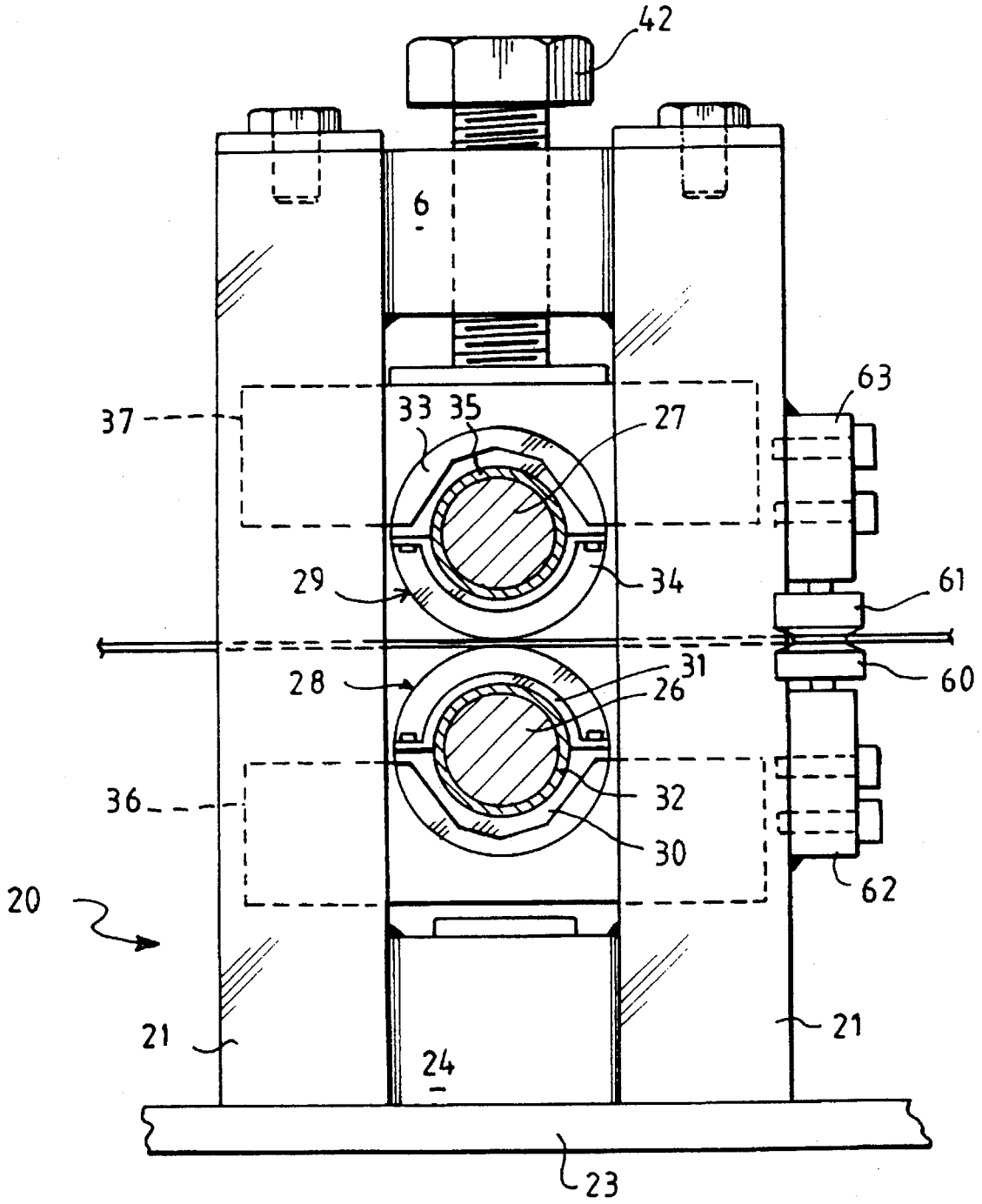
FIG. 9 is a side elevational view of the device of FIG. 8.

As shown in FIG. 9, the bearings 28 are each formed by a semicylindrical cradle 30 closed by a semi-cylindrical bracket 31.

The bearings 29 each possess a bearing bush 32.

The bearings 28 are also each formed by a semi-cylindrical cradle 33 closed by a semicylindrical bracket 34.

The bearings 29 each possess a bearing bush 35.

The bearings 28 are associated with fixed plates 36 mounted on the columns 21 and 22.

The bearings 29 are associated with guide plates 37 mounted so as to move vertically on the columns 21 and 22.

As shown in FIG. 8, each drive shaft 26 and 27 carries an corrugating roll, respectively 40 and 41.

The shafts 26 and 27 and the corrugating rolls 40 and 41 are driven in synchronism by pinions 38 and 39 fastened respectively to the shafts 26 and 27, which engage with a driving pinion, not shown.

The gap between the corrugating rolls 40 and 41 is adjusted by means of screw bolts 42 and 43 acting on the upper plates 37.

Limit-stops, not shown, enable the descent of the upper plates 37, and consequently of the bearings 29 and of the corrugating roll 41, to be limited so as to prevent this corrugating roll 41 coming into contact with the corrugating roll 40.

As shown in FIGS. 8 and 10 to 13, each corrugating roll 40 and 41 possesses a set of independent and juxtaposed discs 44 mounted on the corresponding drive shaft 26 or 27.

The working faces 44A of the discs 44 are provided, for example, with projecting parts 44B (FIG. 11) of conjugate shape in order to produce the ribs 12 on the faces of the strip.

Moreover, the manufacturing device possesses means for the relative positioning of the projecting parts 44B of each disc 44 in relation to the adjacent discs 44 depending on the distribution of the ribs 12 on the faces of the strip, and means for linking the discs 44 of each set together and with the corresponding drive shaft 26 or 27.

Figure 10:
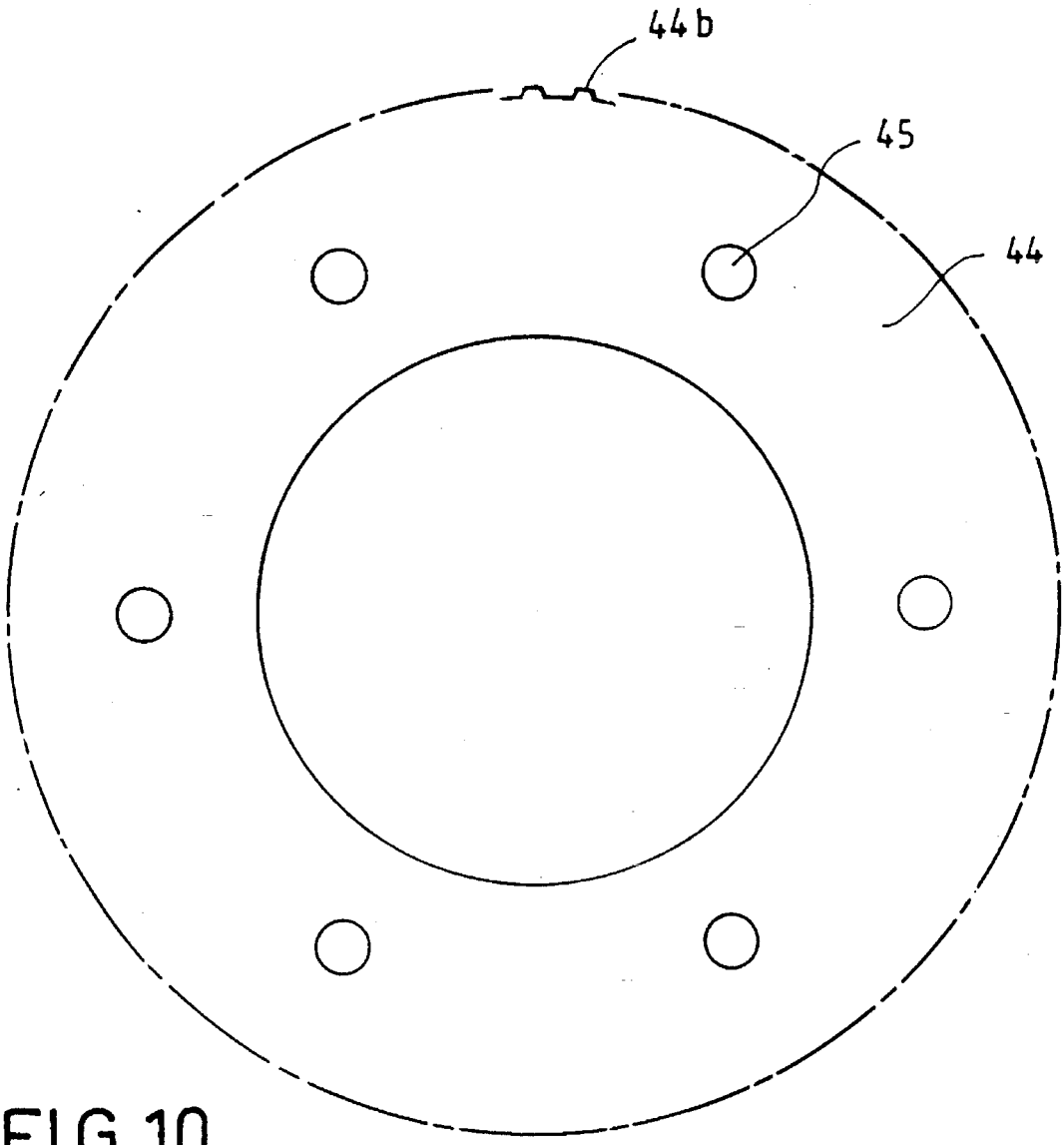
FIG. 10 is a side elevational view of a disc of a corrugating roll of the manufacturing device.

The means for the relative positioning of the projecting parts 44B of each disc 44 in relation to the adjacent discs 44 are formed, as shown in FIG. 10, by transverse holes 45 which are angularly and radially distributed over the lateral faces of each of the said discs 44.

The axes of the holes 45 are parallel to the axis of the corresponding drive shaft 26 or 27 of the discs 44.

Figure 13:
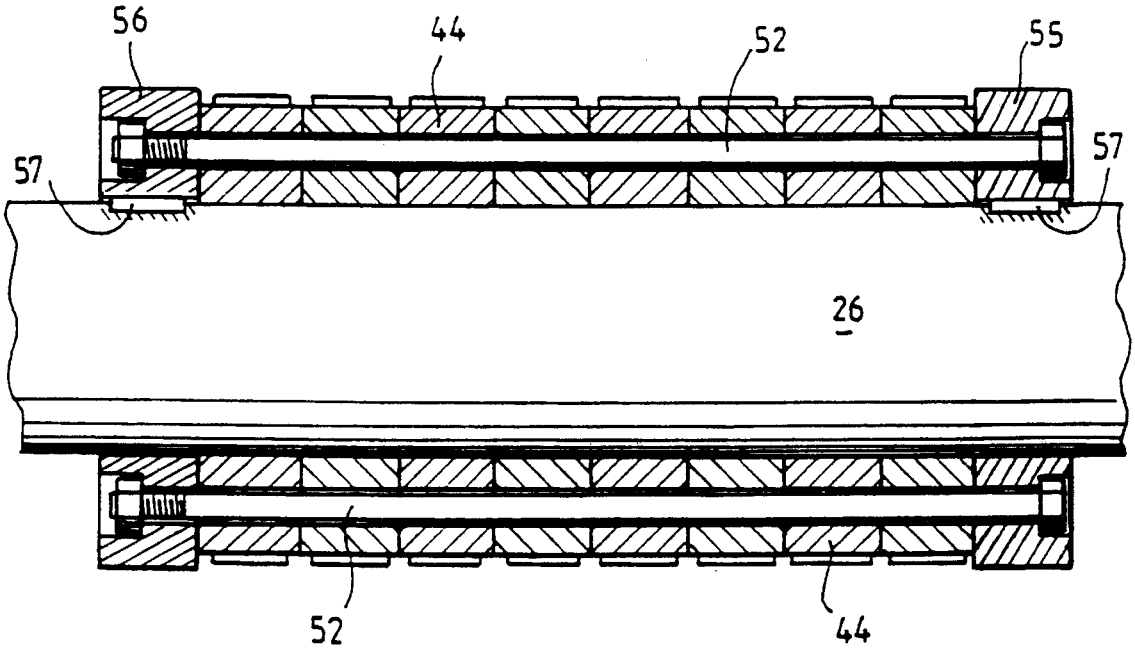
FIG. 13 is a partial sectional view of a second embodiment of a corrugating roll.

As shown in FIGS. 10, 13 and 14, each disc 44 has a central hole 46 for the passage of the drive shaft 26 or 27.

Figure 11:
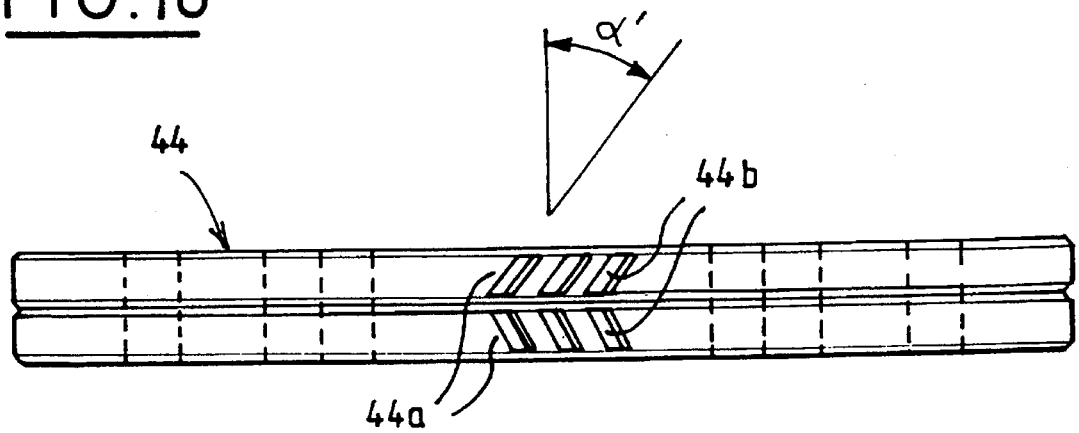
FIG. 11 is a view from above of several juxtaposed discs.

Preferably, the projecting parts 44B of each disc 44 are inclined at an angle $\alpha'$ in relation to the axis of the said disc, as shown in FIG. 11.

This angle $\alpha'$ corresponds to the angle $\alpha$ of the ribs 12 which it is desired to form on the faces of the strip.

Depending on the distribution of the ribs 12 on the faces of the strip, the user may have at his disposal several series of discs 44, the angular distribution of the holes 45 of which is different so as to be able to offset the projecting parts 44B of one disc 44 in relation to one or two adjacent discs, thereby enabling rows of ribs 12, mutually offset longitudinally, to be formed on the faces of the strip.

Moreover, the discs 44 may be reversed in relation to each other, as shown in FIG. 11, so that the projecting parts 44B of each disc 44 in relation to the adjacent discs have opposite angles of inclination $\alpha'$.

Figure 12:
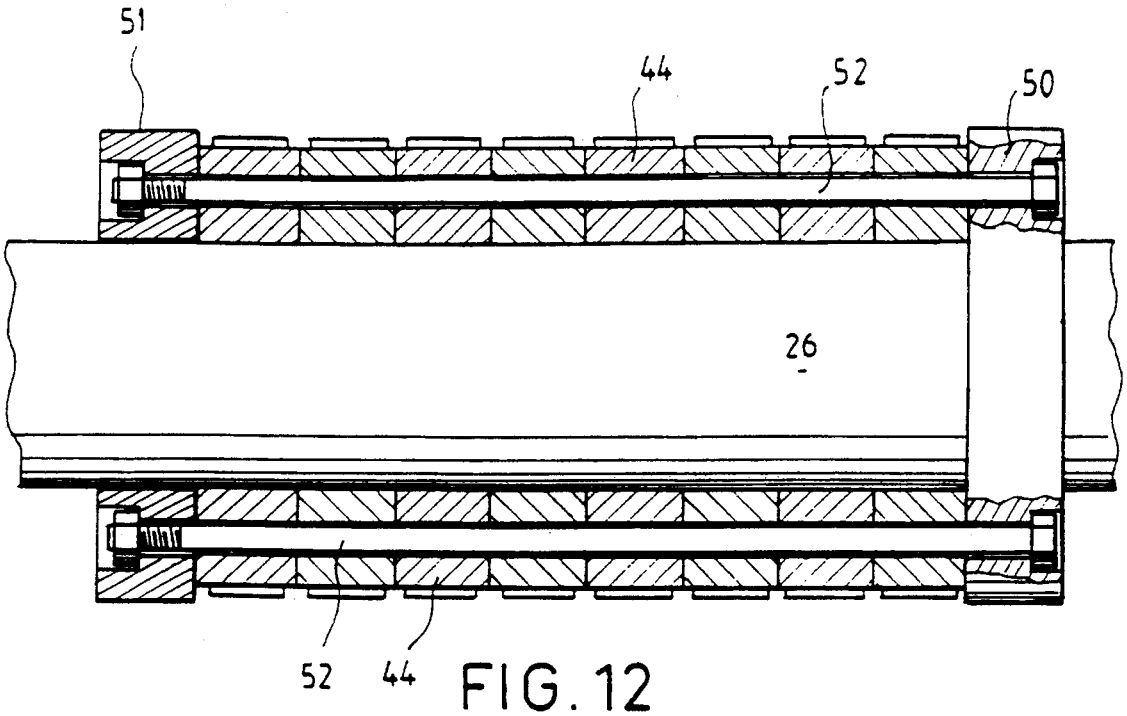
FIG. 12 is a partial sectional view of a first embodiment of a corrugating roll.

Referring now to FIG. 12, a first embodiment will now be described of the means for linking the discs 44 of the corrugating roll 40 with the drive shaft 26, the means for linking the discs 44 of the corrugating roll 41 with the drive shaft 27 being identical.

These means for linking the discs 44 with the drive shaft 26 are formed, on the one hand, by two parallel plates 50 and 51 gripping the said discs 44 and, on the other hand, by ties 52 connecting the two plates 50 and 51 and passing through the discs 44 via the holes 45.

One of the plates, for example the plate 50, carries the drive shaft 26, whereas said drive shaft 26 passes through the other plate 51.

The discs 44 are therefore rotationally driven by the ties 52 interacting with the plate 50.

According to a second embodiment, shown in Figure 13, the means for linking the discs 44 with the drive shaft 26 are formed, on the one hand, by two parallel side-plates 55 and 56 gripping the discs 44 and being rotationally integral with the drive shaft 26 by means of a key 57 and, on the other hand, by ties 52 connecting the two side-plates 55 and 56 and passing through the discs 44 via the holes 45.

The means for linking the discs 44 of the corrugating roll 41 with the drive shaft 27 are identical.

According to another embodiment, not shown in the figures, the drive shaft 26 or 27 may be formed by two half-shafts, each carrying a plate at one end. Each half-shaft is mounted in a bearing supported by the columns 21 and 22. The means for linking the discs 44 with the plates of the two half-shafts are also formed by the ties 52 which pass through the said discs via the holes 45. In this case, the discs 44 possess only the holes 45 for the passage of the ties 52.

The device also possesses guide means upstream and downstream of the corrugating rolls 40 and 41 in relation to the running direction of the said strip.

Thus, as shown in FIG. 9, one of the guide means is formed by at least two grooved rollers 60 and 61 arranged on either side of the plane of the strip and each carried by an adjustable support, respectively 62 and 63.

Grooved rollers 60 and 61 enable the lifting effect and the skiing effect of the strip to be simultaneously counteracted.

The device also includes means for slitting the strip so as to form tapes of desired width and means for grinding the longitudinal edges of the tapes.

These means, not shown in the figures, are constituted, for example, by a conventional cutting tool and by a grinding wheel enabling two adjacent edges resulting from the slitting of the strip into tape to be ground simultaneously.

The invention possesses many advantages.

Tensile tests on the steel reinforcement members according to the invention, embedded in plain concrete or lean concrete, have demonstrated that these reinforcement members show optimized mechanical behaviour compared to conventional reinforcement members, in particular for very small relative movements between the steel and the concrete.

The tape form of the reinforcement member according to the invention enables a very long reinforcement member to be supplied which can be packaged as a reel compatible with handling normally carried out on a work site.

Because of its high elastic limit, the reinforcement tape according to the invention remains very flat and straight after unreeling.

The reinforcement tape according to the invention, of small thickness, possesses a ratio T:

$$T = \frac{\text{adhering surface area per unit length}}{\text{cross-sectional surface area}}$$

greater than that of conventional reinforcement members of circular cross-sections. This high ratio, as well as the ribs arranged on the reinforcement tape according to the invention, make it possible to obtain very good adhesion and very good anchoring of this reinforcement member in the concrete structures normally used for the construction of motorway pavements or of airport runways.

This very good anchoring in the concrete has the effect of completely mobilizing the strength of the steel for relative movements between the steel reinforcement member and the concrete of at least one quarter of a millimeter due to generally tolerated cracks in the concrete which are of small width, especially due to cracks of a width less than 0.5 mm.

The reinforcement tapes according to the invention make it possible to obtain adhesion and anchoring in the concrete which can exceed the fracture strength of the reinforcement member.

Compared to conventional reinforcement members, the reinforcement member according to the invention possesses the capability of very good anchoring and very good mechanical properties, in particular a very good tensile strength.

The reinforcement member according to the invention, which can be continuously reeled and unreeled, may be used simultaneously with an extruded concrete of the "slip form" type for the continuous production, over a long length, of slabs or panels of constant cross-section.

For the production of a highway or motorway, the reinforcement member according to the invention may be unreeled for the successive or simultaneous reinforcement of the road pavement, the hard shoulders and the low walls for separating the carriageways.

We claim:

1. Reinforcement member for the reinforcement of concrete structures comprising a reelable steel tape for being incorporated into the concrete, wherein opposite faces of the steel tape each have ribs located thereon arranged in at least one longitudinal row, said ribs being substantially parallel to each other and inclined at an angle of inclination $\alpha$ in relation to the longitudinal direction of the tape, the at least one row comprising a first and second row and wherein each face of the steel tape comprises at least two rows of said ribs arranged side by side along the width of the tape, the ribs of said two rows having opposite angles of inclination equal to said angle of inclination $\alpha$ and the two rows of ribs being spaced apart from one another along a central longitudinal axis of the tape.

2. Reinforcement member according to claim 1, wherein the steel tape has an elastic limit greater than 650 MPa.

3. Reinforcement member according to claim 1, wherein the ribs are substantially rectilinearly shaped.

4. Reinforcement member according to claim 1, wherein the angle of inclination $\alpha$ has an absolute value lying between 45° and 90°.

5. Reinforcement member according to claim 1, wherein each face of the steel tape comprises at least two rows of said ribs arranged side by side along the width of the tape, the ribs of said two rows having identical angles of inclination $\alpha$.

6. Reinforcement member according to claim 1, wherein each face of the steel tape comprises an even number of rows of ribs, said rows being distributed symmetrically in relation to the central longitudinal axis of the tape.

7. Reinforcement member according to claim 1, wherein each face of the steel tape comprises at least two rows of said ribs arranged side by side along a width dimension of the tape, and wherein adjacent ends of the ribs of said two opposite rows which are in proximity are spaced apart and mutually offset longitudinally.

8. Reinforcement member according to claim 1, wherein each row of said ribs is bordered laterally by smooth longitudinal areas.

9. Reinforcement member according to claim 1, wherein the ribs (12) of the same row are spaced apart longitudinally with a constant pitch lying between 3 and 20 mm.

10. Reinforcement member according to claim 1, wherein the width of the base of each of said ribs lies between 1 and 4 mm.

11. Reinforcement member according to claim 1, wherein the height of each of said ribs lies between 0.1 and 0.5 mm.

12. Reinforcement member according to claim 1, wherein the cross-section of each of said ribs is substantially delimited by an isosceles trapezium, the non-parallel sides of which make an angle $\beta$ of approximately 45° in relation to the base of said trapezium.

13. Reinforcement member according to claim 1, wherein the steel tape comprises an oblong hole and a hook which are both arranged at opposite ends of the tape, forming means for catching said tape by one of another tape and a reel for reeling up the tape having complementary catching means.

14. Reinforcement member according to claim 13, wherein the oblong hole has a rectangular general shape and the hook is formed by a lanced element of a rectangular general shape made in the tape.

15. Reinforcing member as claimed in claim 1 wherein said reinforcement member comprises one of a road reinforcement member and a runway reinforcement member.

* * * * *